US006344128B1

(12) United States Patent
Toledo et al.

(10) Patent No.: US 6,344,128 B1
(45) Date of Patent: Feb. 5, 2002

(54) AQUEOUS ELECTROPLATING BATH

(76) Inventors: Emil Toledo, 126 Wendell Rd., Newton, MA (US) 02459; Peter J. Belletti, 211 Stone School Rd., Sutton, MA (US) 01590; Lawrence W. Black, P.O. Box 511, Sudbury, MA (US) 01776

( * ) Notice: Subject to any disclaimer, the term of this patent is extended or adjusted under 35 U.S.C. 154(b) by 0 days.

(21) Appl. No.: 09/575,829

(22) Filed: May 18, 2000

(51) Int. Cl.[7] ..... C25D 3/56; C25D 3/12
(52) U.S. Cl. ..... 205/260; 205/274
(58) Field of Search ..... 205/587, 594, 205/595, 259, 260, 271, 274

(56) References Cited

U.S. PATENT DOCUMENTS

| | | | | | |
|---|---|---|---|---|---|
| 3,460,113 | A | | 8/1969 | Maeda | 340/174 |
| 3,508,219 | A | | 4/1970 | Brownlow | 340/174 |
| 3,538,599 | A | | 11/1970 | Michaud | 29/604 |
| 3,616,290 | A | * | 10/1971 | Toledo | 205/259 X |
| 3,643,239 | A | | 2/1972 | Mack | 340/174 DC |
| 3,742,469 | A | | 6/1973 | Crosby | 340/174 DC |
| 3,853,717 | A | * | 12/1974 | Diguilio | 205/258 X |
| 4,016,051 | A | * | 4/1977 | Geldzahler et al. | 205/260 |
| 4,108,740 | A | * | 8/1978 | Wearmouth | 205/255 X |
| 4,158,433 | A | | 6/1979 | Peterson | 235/330 |
| 4,384,929 | A | * | 5/1983 | Tremmel et al. | 205/259 X |

* cited by examiner

*Primary Examiner*—Donald R. Valentine

(57) ABSTRACT

Described is an aqueous nickel-iron alloy electroplating bath comprising 260–280 grams/liter nickel chloride; 10–15 grams/liter ferrous ammonium sulfate; 0.8–1.9 grams/liter acid saccharin and 0.4–1.9 grams/liter of naphalene trisulfonic acid. Also, an aqueous nickel electroplating bath is described comprising 230–310 grams/liter nickel chloride, 0.1–1.9 grams/liter acid saccharin and 0.4–1.9 grams/liter napthalene trisulfonic acid.

7 Claims, No Drawings

AQUEOUS ELECTROPLATING BATH

BACKGROUND OF THE INVENTION

All-chloride based aqueous electroplating bath, for electroplating nickel only, is disclosed. The all-chloride bath has nickel chloride as the source of the nickle ions deposited in the nickel plate. The disclosed bath has a high level of acid saccharin or sodium saccharin, at a concentration of such as 1.1 grams per liter. Napthalene tri-sulfonic acid, at a concentration of such as 1.1 grams per liter is also included. Bright nickel is electroplated from this bath at a high rate of up to 80 amps per foot square. This bath is an all-chloride bath which was used to take advantage of the beneficial effects the chloride ion has during the electrodynamics that occur during the plating process.

A nearly all-chloride based aqueous electroplating bath, for electroplating nickel-iron alloy, is disclosed. The nearly all-chloride bath has nickel chloride and ferrous ammonium sulfate, as the sources of a nickel-iron alloy plate. The disclosed bath includes a high level of acid saccharin or sodium saccharin, such as 1.1 grams per liter, plus a normal level of napthalene tri-sulfonic acid, such as 1.1 grams per liter. The bath also contains hydrocloric acid to reduce the ph to about 2.3. Bright nickel-iron alloy is electroplated from this bath at a high rate of up to 60 amps per foot square.

The addition of ferrous ions iron, from ferrous ammonium sulfate, was made to the nickel-only plating bath, to produce a nickel-iron alloy plating bath, Ferrous ammonium sulfate was used because that compound produces a more stable nickel-iron alloy plating bath than does ferrous chloride. A nickel-iron alloy plating bath was produced. The nickel-iron plating bath was used to plate a nickel-iron magnetic keeper.

The disclosed nickel-iron alloy plating bath includes nickel chloride as a compound that provides nickel ions for incorporation into the nickel-iron alloy magnetic keeper. The disclosed aqueous solution includes ferrous ammonium sulfate as a compound that provides ferrous iron ions for incorporation into the nickel-iron alloy magnetic keeper.

The nickel-iron alloy will serve as a magnetic keeper when the nickel-iron alloy is electroplated onto a metal electrical conductor. Such an electrical conductor could be a word line of a magnetic memory device or other current carrying conductor where flux closure is needed.

Electrons passing through a word line will produce a magnetic field. The magnetic field is significantly confined by the nickel-iron alloy magnetic keeper.

SUMMARY OF THE INVENTION

An aqueous electroplating bath for electroplating a nickel-iron alloy comprising between 260 grams of nickel chloride per liter of water and 280 grams of nickel chloride per liter of water, between 10 grams of ferrous ammonium sulfate per liter of water and 15 grams of ferrous ammonium sulfate per liter of water, between 0.8 grams of acid saccharin per liter of water and 1.9 grams of acid saccharin per liter of water, and between 0.4 grams of napthalene trisulfonic acid per liter of water and 1.9 grams of napthalene tri-sulfonic acid per liter of water.

DESCRIPTION OF THE PREFERRED EMBODIMENT

Ingredients for use in theoretical aqueous electroplating baths for electroplating nickel-iron alloy are given below in table 1. It is noted in the table 1 that nickel ions in the electroplating bath all come from nickel chloride compound. Ferrous iron ions all come from a ferrous ammonium sulfate compound.

It is noted that, theoretically, in place of ferrous ammonium sulfate, ferrous chloride could be used as the source of ferrous iron ions in the plating bath of table 1, although the ferrous ions would be unstable and would more readily convert to ferric ions in such a plating bath. A nickel-iron alloy magnetic keeper could theoretically be plated using the following ingredient in a plating baths;

(1) a bath having nickel sulfate and ferrous ammonium sulfate in water;

(2) a bath having nickel sulfate and ferrous chloride in water;

(3) a bath having nickel sulfate, nickel chloride and ferrous ammonium sulfate in water;

(4) a bath having nickel sulfate, nickel chloride and ferrous chloride in water;

(5) a bath having nickel ammonium sulfate and ferrous ammonium sulfate in water;

(6) a bath having nickel ammonium sulfate and ferrous chloride in water;

(7) a bath having nickel sulfamate and ferrous ammonium sulfate in water;

(8) a bath having nickel sulfamate and ferrous chloride in water;

(9) a bath having nickel chloride and ferrous ammonium sulfate in water;

(10) a bath having nickel chloride and ferrous chloride in water;

(11) a bath having nickel fluoroborate and ferrous ammonium sulfate in water;

(12) a bath having nickel fluoroborate and ferrous chloride in water;

(13) a bath having any other combination of above mentioned nickel ion containing compounds and above mentioned ferrous iron ion containing compounds in water.

The low solubility of nickel ammonium sulfate in water, the instability of nickel fluoroborate, and the unavailability of reagent grade nickel sulfamate eliminated those compounds from consideration. Experiments had previously indicated that no bright range could be obtained in a bath having 100% nickel chloride, that is, a bath that did not also contain large amounts of saccharine plus napthalene trisulfonic acid.

However a superior electroplating bath would be one that ideally had 100% chloride ions, that is, negatively charged ions exclusively from chloride, because of the following information that was stated on pages 289 and 313 of ▒ Modern Electroplating▒, Third Edition, by Frederick A. Lowenhiem:

▒ CHLORIDE ION- A principle function of the chloride ion is to improve anode dissolution by reducing polarization. It also increases the conductivity of the bath and has marked effects at the cathode. It increases throwing power as a result of increasing cathode efficiency, electrolyte conductivity, and slope of the cathode potential curve. These effects are at a maximum in the all-chloride bath studied in detail by Wesley and Carey, and to a lesser degree in the high-speed bath developed by Pinner and Kinnaman which contains chloride and sulfate in about equal normalities. The interesting effects of chloride ion in the cathode film have been studied though more needs to be done with brighteners present ▒▒▒▒▒▒▒▒.

ALL-CHLORIDE BATH- Blum and Kasper worked with an all-chloride bath operated at the boiling point. Later, Wesley and Carey made a comprehensive study of the chloride-boric acid electrolyte and the properties of the deposits produced. Deposits are smoother, fine grained, harder, and stronger than those from a Watts bath and more highly stressed. Although it is possible to operate this bath under conditions giving hardnesses over 400 Vickers, such deposits are so highly stressed that they may crack spontaneously. High conductivity of the all-chloride bath permits operation at lower voltages, saving power costs. High current densities can be employed, anode and cathode efficiencies are high, and deposits have less tendency to form pits, nodules, and trees.▒

Unfortunately, it is shown at pages 313 and 314 of ▒Modern Electroplating▒, that the all-chloride ion bath plates a hard, strong, highly stressed permalloy plating which tends to produce a permalloy with high Hc, over 2 oersted, low permeability u, and properties which change with time (poor aging).

Thus: while using a nearly all-chloride containing bath to plate a nickel-iron alloy magnetic keeper; one must reduce the internal stress, broaden the bright plating range and produce the fine equiaxial grain structure needed to generate the desired magnetic properties, such as an Hc of less than 0.4 oersteds and a permeability of over 10,000.

This was accomplished by producing an aqueous electroplating bath for plating a nickel-iron alloy, the plating bath having of the ingredients:

TABLE 1

COMPOSITION OF AQUEOUS ELECTROPLATING BATH FOR NICKEL-IRON ALLOY

| | COMPOSITION | | ANALYSIS |
|---|---|---|---|
| | START | CURRENT | GRAMS/LITER |
| Ferrous Ammonium Sulfate $Fe(SO_4)_2(NH_4)_2 + 6H_2O$ | 300 gms | 350 gms* | 2.3 g/l Fe ions |
| Nickel Chloride $NiCl_2 + 6H_2O$ | 7,000 gms | 7,000 gms | 63.5 g/l Ni ions |
| Boric Acid $H_3BO_3$ | 475 gms | 475 gms | 17.5 g/l |
| Sodium Laural Sulfate $CN_3(CH_2)_{11}OSO_3Na$ | .2 gms | 2.2 gms | .08 g/l |
| Acid Saccharin | 4 gms | 20–50 gms | 1.1 g/l |
| Napthalene Tri-Sulfonic Acid (NTS) | 11.5 gms | 10–50 gms | 1.1 g/l |
| De-ionized Water | 26 liters | 26 liters | |
| HCl | 0 | 10 ml* | |
| Ph | 2.8 | 2.3 | |
| Temperature | 30–50 degrees C. | 44 +/− 1 degrees C. | |

*Ferrous Ammonium Sulfate added to produce ferrous iron ion level of 2.23 +/− .05 gms/liter and HCl to lower Ph to 2.3.

The above disclosed electroplating bath for nickel-iron alloy produced a fine grained low stress equiaxial grain structure plating, a plating with close to the ideal nickel-iron permalloy film composition over a broader range of condition than any known bath, and a plating with magnetic properties (Hc and u) which are very reproducible and equal to or better than previously produced. This bath has a bright range of up to 60 amp/ft2 at 44 degrees C., which is superior to all known commercial nickel-iron baths. It also plated well at a pH of 2.3, at which acidity level, ferrous iron ions are very stable. Furthermore, it consistently produces a low stress defect-free plating, with a magnetic film with an Hc of less than 4 and u of over 10,000. This bath also has several unique and surprising features:

(1) Saccharine is generally considered a primary brighter of nickel containing baths and thus attains its maximum effectiveness at very low concentration levels of no more than 100 mg/liter at this level. The extent to which it effected the bright range of the nearly all-chloride bath was negligible. However, at high concentration levels of 1–2 gms/liter, when used in combination with naphthalene tri-sulfonic acid, tri-sodium salt, and sodium laural sulfate, it seems to act like a secondary brighter and extends the bright range of the bath considerably.

(2) This bath produced a near 0 magnetostriction 81 Ni-19 Fe alloy, namely an 81 percent nickel and 19 percent iron alloy, with a nickel ion to iron ion ratio of approximately 28 +/− 3 to 1. This is far below the 75 +/− 15 to 1 nickel ion to iron ion ratio observed for other baths evaluated. The high iron ion level means that iron ion depletion during plating will be minimal and plating alloy chemistry will be more consistent over a period of time.

(3) A low stress(<10,000 psi) nickel-iron alloy, was plated from a nickel-iron plating bath. The nickel-iron plating bath had almost all negative ions from chloride, and operating at a Ph of less than 2.5 and a temperature of less than 50 degrees C., is unique.

The addition of HCl was made to the nickel-iron plating bath to lower the Ph to 2.3. A Ph of 2.3, lowered the maximum current density to 60 amps/ft2. This latter current density is below a maximum current density of 80 amps/ft2, but the 60 amps/ft2 current density is above the maximum current density for any other nickel/iron bath. The nickel-iron plating bath operated at a Ph of 2.3, and at a temperature of 44 degrees celsius, at which Ph and temperature ferrous iron ions are stable. This bath consistently produced superior nickel-iron permalloy plating, for plated keeper application, than any known bath.

A surprising feature is the effectiveness of the large quantities of saccharine, to 1.1 g/liter, (less than 0.2 g/liter is normally used for nickel baths) in combination with naphthalene trisulfonic acid. Superior nickel-only and nickel-iron plating baths were produced by using a large quantity of saccharine, plus napthalene trisulfonic acid.

In order to get the same number of ferrous ions by using ferrous chloride, FeCl2, rather than by using ferrous ammonium sulfate, Fe(SO4)2(NH4)2+6H2O, in the above described bath, theoretically, 113.43 grams of ferrous chloride would be used in place of the 350 grams of ferrous ammonium sulfate. In place of a use of the initial 300 grams of ferrous ammonium sulfate, in the above described bath, 97.1 grams of ferrous chloride, FeCl2, would be used.

A memory device, having conductive lines such as word lines that are to be coated with a nickel-iron alloy magnetic keeper, is placed in the aqueous electroplatings bath of table 1. The word lines are connected to a negative voltage source. A plating electrode is placed in the aqueous solution at an appropriate plating distance from the memory bath. The plating electrode is connected to a positive voltage source. A plating current sufficient to produce a plating current density of up to 60 amps per feet squared is sent through the plating solution. A nickel-iron alloy magnetic keeper is plated onto the word lines.

An aqueous electroplating bath for electroplating nickel alone, is disclosed below in table 2. It is a all-chloride bath that contains 1.1 gms/liter of napthalene trisulfonic acid and 1.1 gms/liter of acid saccharine or sodium saccharine. Such a nickel-only plating bath plated a very low stress bright nickel plating from a nearly all nickel chloride bath at current densities of up to 80 amps/ft2. This nickel-only plating bath is unique and represents a major breakthrough in the art of plating nickel.

The nickel-only aqueous electroplating bath consisting of the following ingredients:

TABLE 2

COMPOSITION OF AQUEOUS ELECTROPLATING BATH FOR NICKEL-ONLY

| | COMPOSITION | | ANALYSIS |
|---|---|---|---|
| | START | CURRENT | GRAMS/LITER |
| Nickel Chloride NiCl2 + 6H2O | 7,000 gms | 6000–8000 gms | 63.5 g/l Ni ions |
| Boric Acid H3BO3 | 475 gms | 425–525 gms | 17.5 g/l |
| Sodium Laural Sulfate CN3(CH2)11OSO3Na | 0.2 gms | 0.2–2.2 gms | .08 g/l |
| Acid Saccharin | 4 gms | 4–50 gms | 1.1 g/l |
| Napthalene Tri-Sulfonic Acid (NTS) | 11.5 gms | 10–50 gms | 1.1 g/l |
| De-ionized Water | 26 liters | 26 liters | |
| Ph | 2.8 | 2.0–2.8 | |
| Temperature | 30–50 degrees C. | | |

While the present invention has been disclosed in connection with the preferred embodiment thereof, it should be understood that there may be other embodiments which fall within the spirit and scope of the invention as defined by the following claims.

What is claimed is:

1. An aqueous electroplating bath for electroplating nickel-iron alloy, comprising:

(a) between 260 grams of nickel chloride per liter of water and 280 grams of nickel chloride per liter of water;

(b) between 10 grams of ferrous ammonium sulfate per liter of water and 15 grams of ferrous ammonium sulfate per liter of water;

(c) between 0.8 grams of acid saccharin per liter of water and 1.9 grams of acid saccharin per liter of water; and (d) between 0.4 grams of napthalene tri-sulfonic acid per liter of water and 1.9 grams of napthalene tri-sulfonic acid per liter of water.

2. The aqueous electroplating bath of claim 1 and further comprising between 16 grams of boric acid per liter of water and 21 grams of boric acid per liter of water.

3. The aqueous electroplating bath of claim 2 and further comprising between 0.05 grams of sodium laural sulfate per liter of water and 0.1 grams of sodium laural sulfate per liter of water.

4. The aqueous electroplating bath of claim 3 and further comprising between 0 milliliters of hydrochloric acid per liter of water and 0.5 milliliters of hydrochloric acid per liter of water.

5. An aqueous electroplating bath for electroplating nickel, comprising:

(a) between 230 grams of nickel chloride per liter of water and 310 grams of nickel chloride per liter of water;

(b) between 0.1 grams of acid saccharin per liter of water and 1.9 grams of acid saccharin per liter of water; and (c) between 0.4 grams of napthalene tri-sulfonic acid per liter of water and 1.9 grams of napthalene tri-sulfonic acid per liter of water.

6. The aqueous electroplating bath of claim 5 and further comprising between 16 grams of boric acid per liter of water and 21 grams of boric acid per liter of water.

7. The aqueous electroplating bath of claim 6 and further comprising between 0.05 grams of sodium laural sulfate per liter of water and 0.1 grams of sodium laural sulfate per liter of water.

* * * * *